United States Patent [19]

Hunckler et al.

[11] 4,034,885

[45] July 12, 1977

[54] PARTS STORAGE AND DISPENSING CONTAINER

[75] Inventors: Paul J. Hunckler, Huntington; Jeffrey J. Quinn, Indianapolis, both of Ind.

[73] Assignee: Hunckler Products, Inc., Huntington, Ind.

[21] Appl. No.: 713,919

[22] Filed: Aug. 12, 1976

[51] Int. Cl.[2] ..... B65D 1/24; B65D 51/18; B65D 51/04

[52] U.S. Cl. ..... 220/22; 220/23.8; 220/254; 220/339; 220/306

[58] Field of Search ..... 220/20, 21, 22, 23.2, 220/23.4, 23.8, 23.83, 254, 337, 339, 375, 306; 206/538, 539

[56] References Cited

U.S. PATENT DOCUMENTS

| | | | |
|---|---|---|---|
| 2,110,921 | 3/1938 | Scurlock | 220/23.4 |
| 3,139,208 | 6/1964 | Irwin et al. | 220/23.8 |
| 3,322,299 | 5/1967 | Foster | 220/306 |
| 3,893,615 | 7/1975 | Johnson | 220/20 X |

*Primary Examiner*—William Price
*Assistant Examiner*—Steven M. Pollard
*Attorney, Agent, or Firm*—Woodward, Weikart, Emhardt & Naughton

[57] ABSTRACT

A top-opening compartmented rectangular box has a snap-on combination frame and lid assembly, with individually releasable lids for each of the compartments. All compartments can be filled before snapping on the lid assembly, and the box can be inverted and lids opened selectively to dump articles from one compartment at a time as desired.

14 Claims, 16 Drawing Figures

PARTS STORAGE AND DISPENSING CONTAINER

BACKGROUND OF THE INVENTION

1. Field of the Invention

This invention relates generally to containers for small parts, and more particularly to a readily fillable multi-compartmented container from which parts can be removed by dumping one compartment at a time.

2. Description of the Prior Art

A patent showing a dispensing and storage container for small parts such as screws, nails, cotter pins, bolts and the like is U.S. Pat. No. 2,903,127 issued Sept. 8, 1959 to J. R. Dorman. It is a drum-shaped device in which compartments are pie shaped. A rotatable disc is employed to open the compartments one at a time. Some improvement has been needed.

Although multi-compartmented containers of rectangular configuration are known, those known to us heretofore are not particularly suitable to storage and dispensing of varieties of parts by picking up the container and dumping out one compartment at a time. Therefore our efforts were directed toward development of a container suitable for this purpose and which could be produced in large quantities at comparatively low cost, and capable of optimizing use of space in conventional shelving.

SUMMARY OF THE INVENTION

Described briefly, in a typical embodiment of the present invention, a rectangular box having an open top and a plurality of internal dividing walls forming compartments, has a frame on the top thereof receiving a set of lids, the frame being secured to the box by resilient clip means, and the lids being secured in the closed position by resilient clip means but individually releasable for dispensing contents from the compartments individually while maintaining closed the other compartments of the container.

DESCRIPTION OF THE PREFERRED EMBODIMENT

Figure 1:
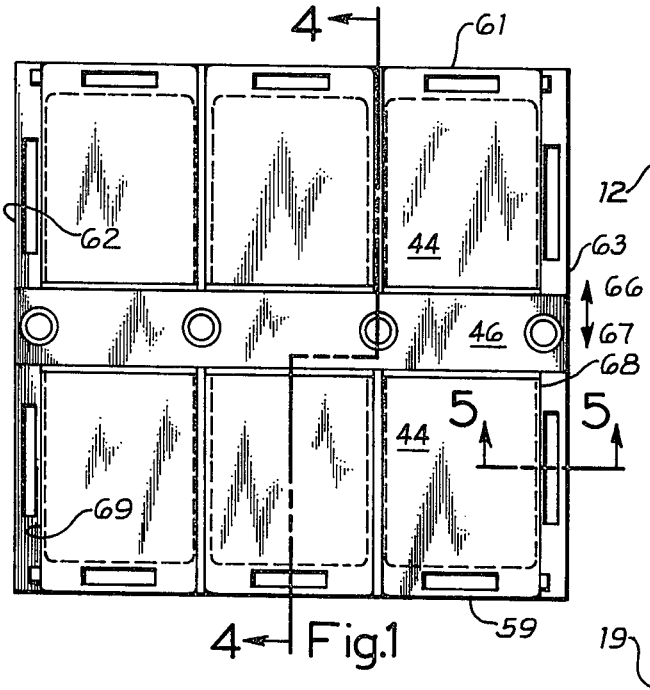
FIG. 1 is a top plan view of a parts storage and dispensing container according to a typical embodiment of the present invention.
Figure 2:
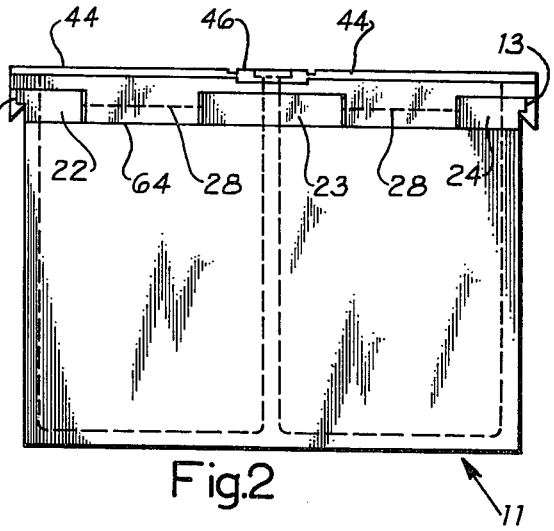
FIG. 2 is a side view thereof.
Figure 3:
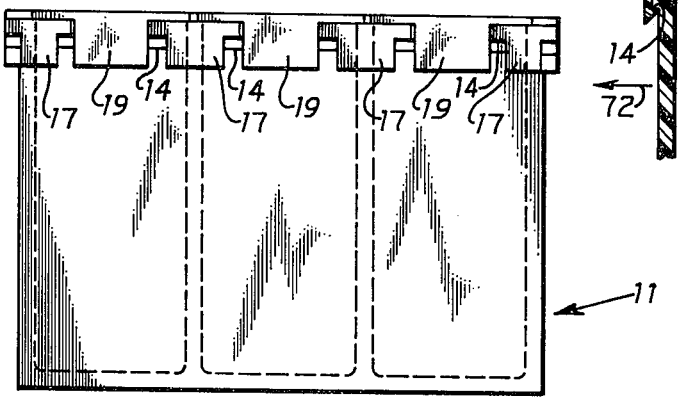
FIG. 3 is a front view thereof.
Figure 4:
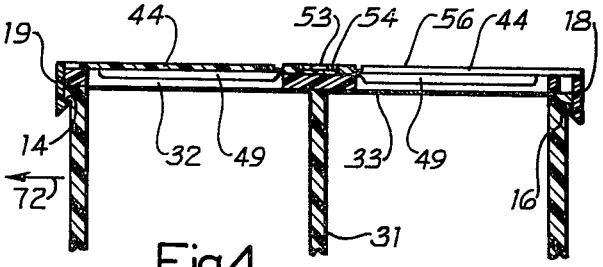
FIG. 4 is a section taken at line 4—4 in FIG. 1 and viewed in the direction of the arrows.
Figure 5:
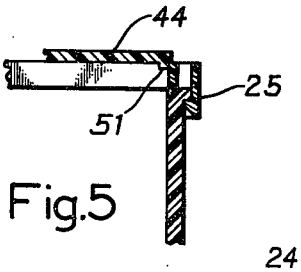
FIG. 5 is a section taken at line 5—5 in FIG. 1 and viewed in the direction of the arrows.
Figure 6:
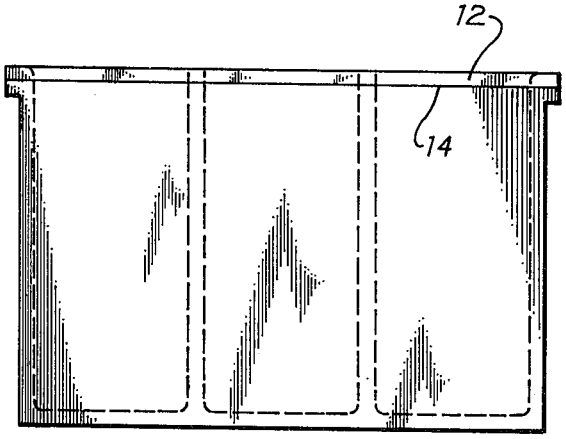
FIG. 6 is a front view of the box itself.
Figure 7:
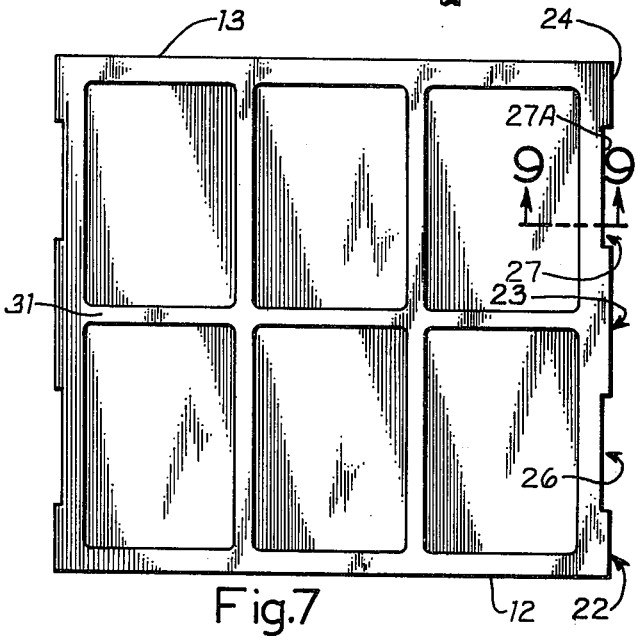
FIG. 7 is a top view of the box itself.

Referring now to the drawings in detail, the container is rectangular as viewed from the top, front and side as shown in FIGS. 1, 3 and 2, respectively. It is an assembly of three pieces as will be more fully described. The bottom piece is the box 11 having four generally vertical walls and interiordivider walls as best seen in FIG. 7 dividing it into six compartments. This unit is preferably molded in polystyrene, and may have an overall length of 3.69 inches, width of 3.4 inches, and height of 2.35 inches, for example.

Figure 11:
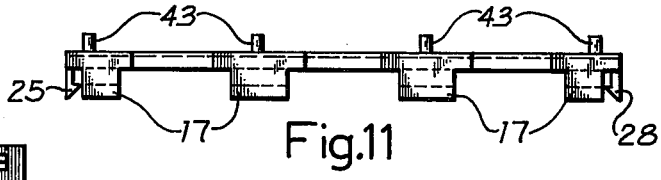
FIG. 11 is a front view of the lid-receiving frame.
Figure 10:
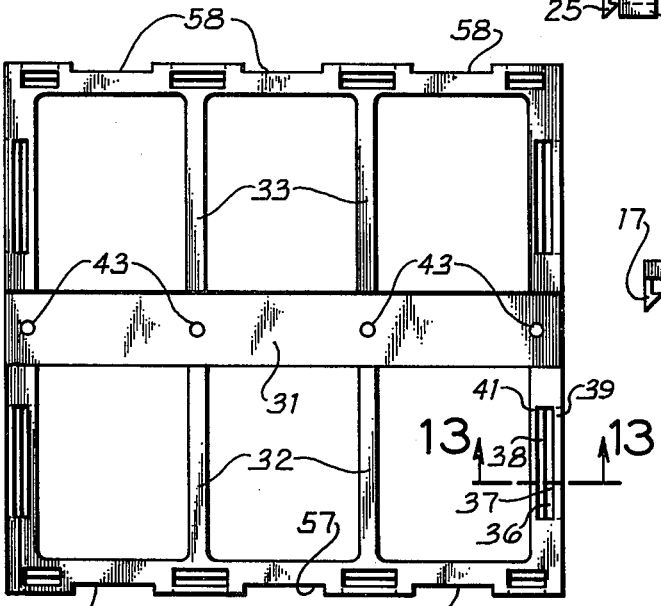
FIG. 10 is a top view of the lid-receiving frame.
Figure 12:
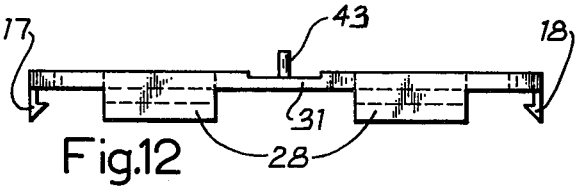
FIG. 12 is a side view of the lid-receiving frame.
Figure 13:
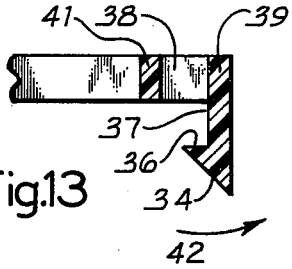
FIG. 13 is a section taken at line 13—13 in FIG. 10 and viewed in the direction of the arrows.
Figure 15:
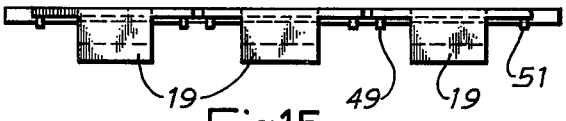
FIG. 15 is a front view thereof.
Figure 14:
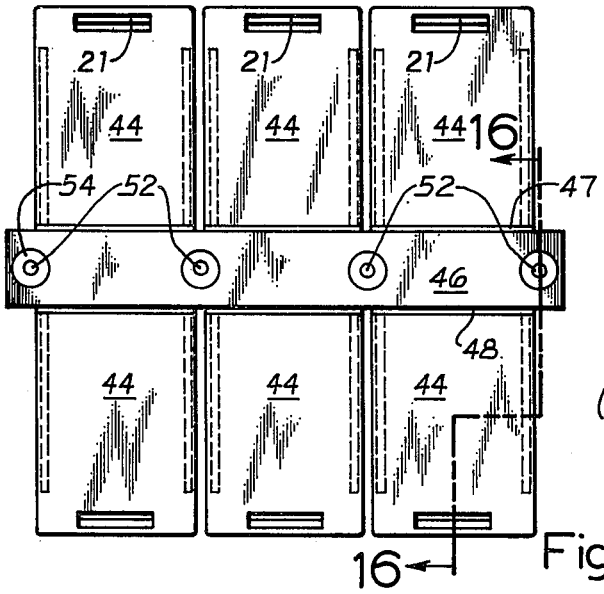
FIG. 14 is top plan view of the lid unit.
Figure 16:
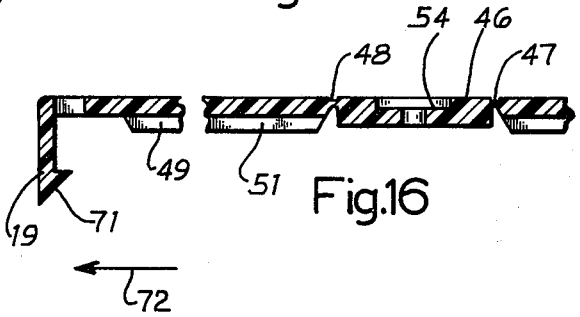
FIG. 16 is an enlarged fragmentary section of the lid unit taken at line 16—16 in FIG. 14 and viewed in the direction of the arrows.

Although the walls of the box are generally smooth, there are some flanges and notches provided. For example, flanges 12 and 13 are provided at the front and rear walls at the top margin of the box. The lower faces 14 and 16 of flanges 12 and 13, respectively, provide downwardly facing ledges to cooperate with clips 17 and 18 of the lid-receiving frame (FIGS. 11 and 12) and clips 19 and 21, respectively, of the front and rear sets of lids of the lid unit (FIGS. 14, 15 and 16).

Figure 8:
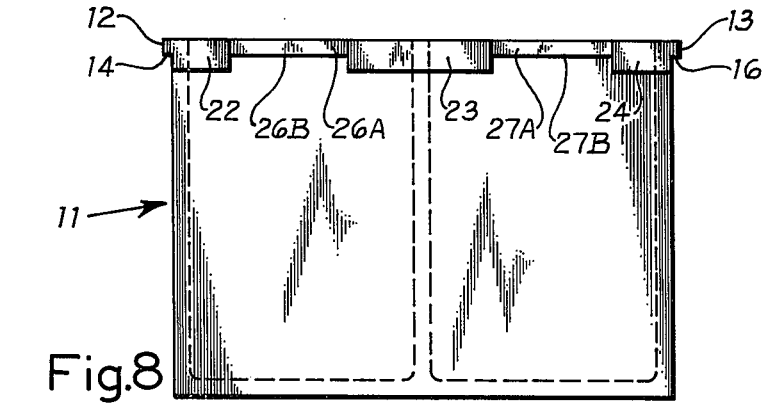
FIG. 8 is a side view of the box itself.
Figure 9:
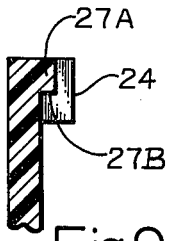
FIG. 9 is a section taken at line 9—9 in FIG. 7 and viewed in the direction of the arrows.

The sides of the box are provided with bosses such as 22, 23 and 24 (FIG. 8) with recesses between the bosses at 26 and 27. These recesses nevertheless are provided with flanges 26A and 27A of the same lateral and vertical dimensions as the flanges 12 and 13, thereby providing similar downwardly facing ledges 26B and 27B. These ledges cooperate with end clips such as 28 (FIG. 11) of the lid adapter frame. The opposite side or end of the box is constructed in the same way as that shown in FIG. 8 and which has just now been described.

Referring now to FIGS. 10–13, there is shown the lid-adapter frame which can be made of polystyrene, just as can the box, for example. This frame is generally rectangular and has the clips 17 and 18 on the front and rear margins and projecting downwardly therefrom, and clips 25 and 28 on the left and right side margins, projecting downwardly therefrom as shown. The frame has a main central support rib 31 extending from the left to the right side thereof, and intermediate transverse ribs 32 and 33 extending therefrom to the front and rear marginal portions of the frame, respectively. It should be understood that all of these features of the frame are of one integral homogeneous unit of material, as are the clips to which previous reference has been made. The clip detail is better seen in FIG. 13 where it is shown to have a tapered leading or entry face 34 terminating in a flat, horizontal ledge or latching surface 36 projecting from the inner face 37 of the clip immediately below the slot 38 between portions 39 and 41 of the right side marginal portion of the frame. These features, together with the construction of a comparatively resilient material, accommodate bending outwardly in the direction of arrow 42 against resilient resistance of the clip, so that it will normally return to the position shown in FIG. 13. All of the clips on the frame are constructed in the same way so that the frame, as a unit, can be snapped down over the box for assembly as shown in FIGS. 1–4.

The central rib portion 31 is provided with four upwardly projecting longitudinally spaced pins 43 for reception of the lid unit which will now be described.

Referring now to FIGS. 14–16, the lid unit is shown. It also may be molded in one integral homogeneous unit of material. It is presently believed that the preferable material is polypropylene for the reason that the six lids 44 are hinged to the lid mount portion 46 by "living" hinges 47 and 48. Each of the lids is flat on top and has a clip such as 19 at the outer or swinging edge of the lid. Each lid also has a pair of ribs such as 49 and 51 (FIGS. 15 and 16) spaced for fitting reception within the corresponding opening in the lid adapter frame when the lid is closed.

For mounting the lid unit to the lid adapter frame, the central portion 46 is provided with four longitudinally aligned and spaced apertures 52 sized to receive the pins 43 of the lid adapter frame. Accordingly the lid mount portion 46 of the lid unit can be superimposed on the central rib portion 31 of the lid adapter frame, and the top ends of the pins 43 can be heat staked to provide a knob 53 (FIG. 4) spread into the recess 54 in portion 46 whereby the knob cannot pass through the aperture 52 and securely retains the lid unit to the lid adapter frame. The provision of the recess 54 for reception of the knob, and the flat top surface of the knob, flush with the flat top surfaces 56 of the lids, provides for a completely flat top of the box assembly to facilitate stacking of these assemblies. Also the flat tops of the lids facilitate labeling with pictures and indicia indentifying the content of the compartment under the lid.

As mentioned before, the frame can be snapped onto the box. This can be accomplished before or after the mounting of the lid unit to the frame. If the lid unit is mounted to the frame before assembly with the box, the lids can all be clippedto the box at the same time as the frame is clipped to the box, as the recesses 57 and 58 in the front and rear marginal edges (FIG. 10) respectively of the frame unit accommodate the lid clips just as the recesses 27 and 26 in the box sides accommodate the frame clips in assembly. Therefore, when the unit is completely assembled as shown in FIG. 1, both the front marginal edge 59 and rear marginal edge 61, and left and right side marginal edges 62 and 63 at the top, are completely smooth. This facilitates installation and removal of the box from the cabinet shelf or the like. An additional feature is that, because of the provision of the bosses 22, 23 and 24 on the sides of the box and which extend down to the level of the lowermost point of the clip on the frame at line 64 (FIG. 2) there is no possibility that the lower edges of the frame side clips 25 or 28 can become snagged on the edge of a shelf or the like as the box is installed in or removed from the shelf as in the direction of arrows 66, 67 in FIG. 1, for example. It can also be seen by reference to FIGS. 1 and 3 that the sides of the lids such as at 68 and 69 are wholly inset with respect to the side margins 63 and 62, respectively, of the container, so there is no interference with the lids as the container is moved into and out of the cabinet in the direction of arrows 66 and 67.

Because of the nature of the clips on both the frame and the lids, and the ledges against which they bear after the assembly is snapped together, they securely lock the frame to the box and the lid to the box. Accordingly, after the box is filled with small parts such as nuts, bolts, washers and the like, it can be turned upside down and remain completely intact. It can even be shaken when held upside down. Yet the compartments will remain closed until they are opened by intentional outward bending of a lid clip for the lid to the particular compartment of interest. For example, the fingers can be placed under the tapered leading face 71 of a clip 19 and force exerted in the direction of arrow 72 (FIGS. 4 and 16) perpendicular to the front wall with which the clip is associated, to resiliently bend the clip outwardly for disengagement of the clip with the ledge 14. Then the compartment covered by that lid can be opened and the contents thereof dispensed by tipping the box adequately or inverting it. The remaining compartments will remain closed.

To fill the box, different kinds of parts can be placed into different compartments, or different sizes of the same kind of part can be placed in different compartments of the box. This can be done either manually or by machine filling. Then the frame, either with or without the lids, can be snapped onto the box. If the frame is snapped onto the box without the lids, then the lid unit can be installed on the frame, followed by heat staking, whereupon the lids can then be clipped onto the box. The clipping of the lids onto the box can occur even before the heat staking operation. In contrast, the frame and lid assembly step can be previously performed by heat staking separate from the filling station and, after the container is filled, the frame and lid assembly can be snapped onto the box as a unit, clipping the frame onto the box and clipping the lids onto the box simultaneously.

If it ever became desirable to do so for refilling purposes or otherwise, the frame and lid assembly could be removed from the box by unclipping all of the clips either manually and individually, or in one machine operation using fingers to release all of the clips simultaneously.

It is believed that the foregoing description will make it apparent that the present invention has a variety of uses and is not necessarily confined to the utilization for storage of small parts such as nuts and bolts, as other small items can also be segregated and stored therein and dispensed therefrom as well.

While there have been descried above the principles of this invention in connection with specific apparatus, it is to be clearly understood that this description is made only by way of example and not as a limitation in the scope of the invention.

What is claimed is:

1. A parts storage and dispensing container comprising:

a rectangular box having an open top and having a plurality of internal divider walls dividing the box into a plurality of upwardly-opening compartments, said box having outwardly-projecting, downwardly-facing ledge means thereon;

a lid adapter frame having resilient clip means engaging said ledge means and securing said frame on top of said box; and lid means including a lid mount portion secured to said frame and having a plurality of lids hingedly connected to said mount portion and located to cover said compartments, said lids having resilient clip means engaging said ledge means to hold said lids in compartment-closing position.

2. The container of claim 1 wherein:

said lid mount portion has a plurality of longitudinally spaced apertures therein;

said frame has a plurality of pins longitudinally spaced along a line centrally located between front and rear edges of said frame, said pins extending through said apertures and having knobs on the upper ends thereof impassable through said apertures and retaining said mount portion snug against said frame.

3. The container of claim 1 wherein:

said ledge means include a ledge along a front wall of said box and a ledge along a rear wall of said box;

said lid means include individual lids covering each of said compartments, each of said lids having a resilient clip engaging one of said ledges and disengageable independently of each other lid whereby one compartment at a time can be opened.

4. The container of claim 3 wherein:

the bottom of the box is flat and the lids are flat, to facilitate labeling the lids and vertically stacking filled containers.

5. The container of claim 3 wherein:

said clip means of said frame are resilient clips and alternate with said clips of said lids along the front and rear walls of said box.

6. The container of claim 5 wherein:

there is one more frame clip than lid clip at each of the front and rear walls of the box.

7. The container of claim 3 wherein:

each lid is joined to said lid mount portion by an integral hinge.

8. The container of claim 7 wherein:

said box and frame are made of polystyrene, and said lid mount portion, lids and integral hinge are made of polypropylene.

9. The container of claim 7 wherein:

said ledge means include ledges along left and right side walls of said box, said resilient clip means on said frame include resilient clips engaging said ledges at the front, rear, left and right side walls of said box, said box having recesses in side wall portions receiving the clips at the sides of said frame to provide a substantially smooth side surface at each side of said frame to facilitate installation and removal of said box from a shelf.

10. The container of claim 9 wherein:

said lids are wholly inset with respect to said side surfaces, and said clips lock against said ledges, said clips being releasable independently of each other by application of force thereto in a horizontal direction perpendicular to the wall having the ledge thereon to which the clip is locked, whereby said frame and lids are removable from said box as a unit.

11. A method of filling and closing a box with an assortment of parts comprising the steps of:

presenting the box with separate compartments open at one margin of the box;

depositing different kinds of parts into different compartments of the box;

framing the box at the margin; and closing the compartments at the frame.

12. The method of claim 11 wherein:

the steps of framing and closing are performed simultaneously.

13. The method of claim 12 wherein:

the step of framing and closing further includes the step of clipping a frame and lid combination onto said box.

14. The method of claim 11 wherein:

the step of closing the compartments comprises closing a plurality of lids and clipping said lids closed, one at a time temporarily whereby said lids can be subsequently unclipped by manipulation of the clip thereon, one at a time.

* * * * *